US007574811B2

(12) United States Patent
Kurtzhals et al.

(10) Patent No.: US 7,574,811 B2
(45) Date of Patent: Aug. 18, 2009

(54) ADJUSTABLE BOW SIGHT APPARATUS

(75) Inventors: Zak T. Kurtzhals, Herriman, UT (US); Darin B. Cooper, Layton, UT (US)

(73) Assignee: Hoyt Archery, Inc., SLC, UT (US)

( * ) Notice: Subject to any disclaimer, the term of this patent is extended or adjusted under 35 U.S.C. 154(b) by 0 days.

(21) Appl. No.: 11/770,389

(22) Filed: Jun. 28, 2007

(65) Prior Publication Data

US 2009/0000134 A1 Jan. 1, 2009

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | |
|---|---|---|---|---|
| 2,959,860 | A * | 11/1960 | Kowalcyk | 33/265 |
| 3,787,984 | A * | 1/1974 | Bear et al. | 33/265 |
| 4,875,290 | A * | 10/1989 | Finch | 33/265 |
| 5,414,936 | A * | 5/1995 | Sappington | 33/265 |
| 5,941,226 | A * | 8/1999 | Marietta | 124/87 |
| 6,000,141 | A | 12/1999 | Afshari | |
| 6,401,347 | B1 | 6/2002 | Slates | |
| 6,430,822 | B1 | 8/2002 | Slates | |
| 6,477,779 | B1 | 11/2002 | Slates | |
| 6,609,306 | B2 * | 8/2003 | Johnson et al. | 33/265 |
| 6,634,110 | B2 | 10/2003 | Johnson | |
| 6,701,632 | B2 * | 3/2004 | Henry | 33/265 |
| 6,925,721 | B2 * | 8/2005 | Dietz | 33/265 |
| 7,086,161 | B2 * | 8/2006 | Ellig et al. | 33/265 |
| 2006/0005406 | A1 | 1/2006 | Afshari | |
| 2006/0254065 | A1 | 11/2006 | Grace | |
| 2007/0028467 | A1 | 2/2007 | Bradley et al. | |

* cited by examiner

*Primary Examiner*—Amy Cohen Johnson
(74) *Attorney, Agent, or Firm*—Holland & Hart

(57) ABSTRACT

A bow sight including an adjustment system is described herein. The adjustment system may include an elevation adjustment mechanism and a windage adjustment mechanism. The user can adjust the elevation and/or windage of a sight component of the bow sight with the adjustment system. The adjustment system may be configured to allow the user to make very fine or micro-adjustments to the bow sight. The adjustment system may also be compact and easy to use relative to conventional bow sight adjustment systems.

27 Claims, 4 Drawing Sheets

ADJUSTABLE BOW SIGHT APPARATUS

BACKGROUND

Bow sights are devices that are coupled to a bow to help the user aim an archery bow. Although it is possible to shoot a bow without a sight (known as "instinctive shooting"), it is exceedingly difficult to do so accurately—especially at longer ranges. Because of this, most conventional bows, particularly compound bows, are outfitted with some kind of sight. A bow sight may allow even novice archers to be surprisingly accurate—especially if used with a peep-sight or kisser-button.

The trajectory of an arrow changes significantly as a function of horizontal distance. In order to compensate for arrow drop over distance, many bow sights include multiple sight pins that are adjusted to correspond to certain horizontal distances. Each sight pin typically includes sight indicia such as a fiber optic point, which makes it easy for the user to see, especially in low light conditions. The sight indicia of the multiple sight points are most often aligned along a single, vertical axis or line, one over another. Depending on the range of the target, the user must select a sight pin corresponding to the vertical distance to the target, and then align the sight indicia with the target. If the user's range estimation, pin selection, and indicia alignment are correct, then the arrow, assuming it was launched properly, should hit the target.

Bow sights are usually adjustable in one form or another to allow the user to "sight in" the bow sight. For example, the sight pins of most bow sights can be individually adjusted vertically until each sight pin is accurate for a given distance. Some conventional bow sights also have a gang adjustment system—a system that allows all of the sight pins and/or corresponding sight indicia to be moved at once. A gang adjustment system may be useful in situations where all of the sight pins are off by the same amount. This may occur when the user switches to a different arrow shaft and/or point.

Unfortunately, conventional bow sights suffer from a number of disadvantages. For example, the gang adjustment systems used by conventional bow sights make the bow sight large and unwieldy. This makes it more difficult for the user to adjust and/or use the bow sight. Also, some gang adjustment systems use a C-shaped or U-shaped clamp type of adjustment mechanisms. These systems can be adjusted by loosening the clamps, adjusting the bow sight, and then tightening the clamps once the bow sight is in the desired position. Unfortunately, clamp designs can be damaged if the user over tightens them. Accordingly, it would be desirable to provide an improved bow sight and particularly a bow sight that has an improved gang adjustment system.

SUMMARY

A bow sight is provided that includes an improved adjustment system. The adjustment system includes an elevation adjustment mechanism and a windage adjustment mechanism. The adjustment system allows the bow sight to be adjusted when it is coupled to a bow. In one embodiment, the adjustment system may be a gang adjustment system that is configured to move a plurality of sight pins together as a whole.

The bow sight may be configured to be used with any bow. In one embodiment, the bow sight may be configured to be used with a compound bow. In other embodiments, the bow sight may be configured to be used with a recurve bow, long bow, or the like. The bow sight may also include vibration dampening materials to reduce the noise generated when the arrow is released. In one embodiment vibration dampening materials may be coupled to the mounting component and/or the sight housing of the bow sight.

The bow sight may be more compact and easier to use than conventional bow sights. In particular, the adjustment system may be improved to reduce the complexity and size of the bow sight. In one embodiment, the adjustment system may include a stop member that is positioned between the elevation adjustment mechanism and the windage adjustment mechanism. The elevation adjustment mechanism and the windage adjustment mechanism may be compressed together with the stop member to hold the elevation adjustment mechanism and the windage adjustment mechanism in a fixed position. Positioning the stop member between the two adjustment mechanisms reduces the overall size and complexity of the bow sight.

In another embodiment of the bow sight, the elevation adjustment mechanism and/or the windage adjustment mechanism may be configured to move toward one another to hold the elevation adjustment mechanism and/or the windage adjustment mechanism in a fixed position. The elevation adjustment mechanism and the windage adjustment mechanism may each be held in the fixed position by a force that is at least substantially parallel to a lengthwise axis of the bow sight. In one embodiment, the adjustment system may also include a single tightening device that is configured to hold the elevation adjustment mechanism and the windage adjustment mechanism in the fixed position. In another embodiment, the adjustment system may include two or more tightening devices that are configured to hold the elevation adjustment mechanism and the windage adjustment mechanism in the fixed position.

The foregoing and other features, utilities, and advantages of the subject matter described herein will be apparent from the following more particular description of certain embodiments as illustrated in the accompanying drawings.

DRAWINGS

DETAILED DESCRIPTION

Figure 1:
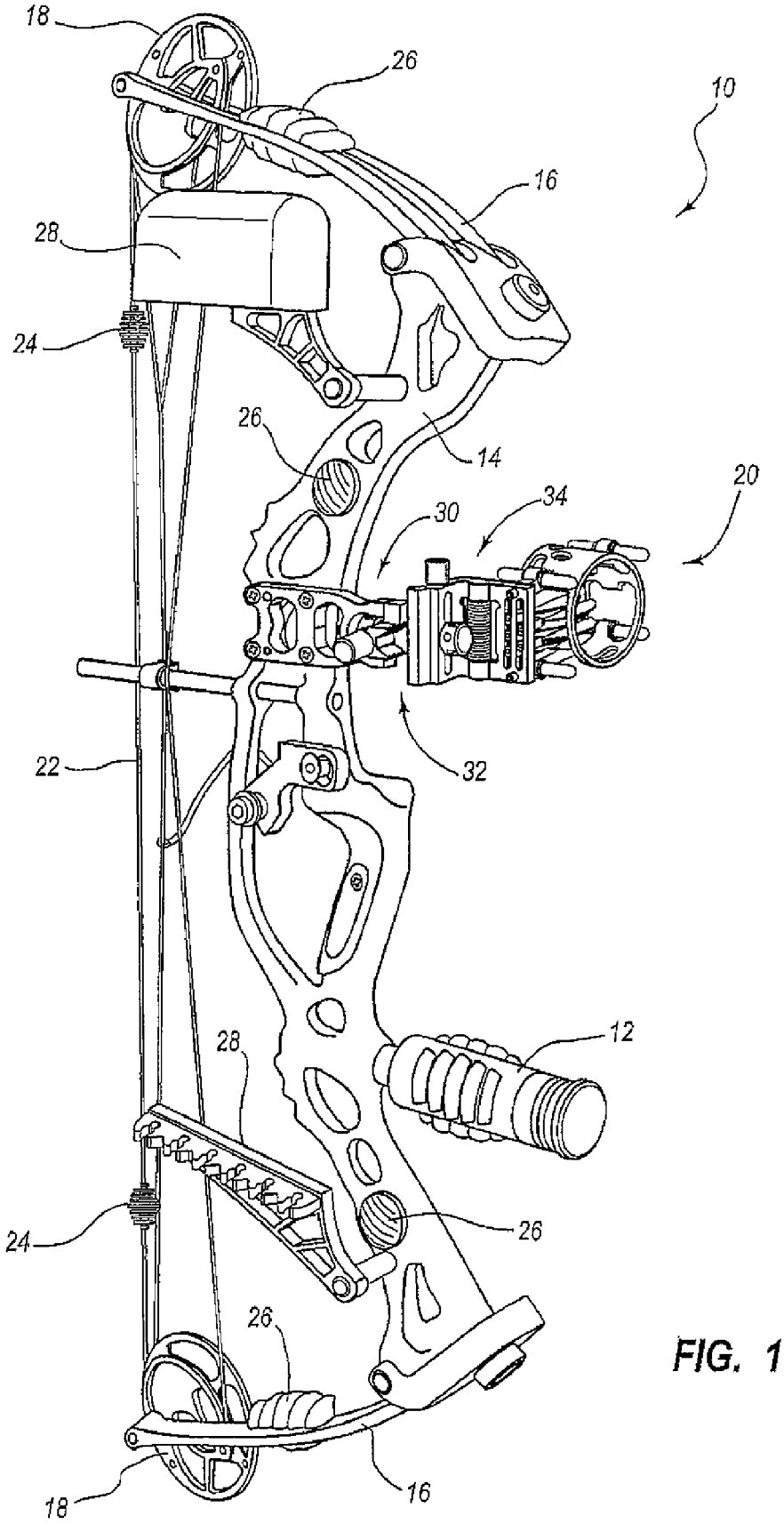
FIG. 1 shows a perspective view of a bow and a bow sight.

Referring to FIG. 1, a bow 10 is shown that includes a bow sight 20, a stabilizer, 12, a riser 14, limbs 16, cams 18, and string 22. The bow 10 also includes bowstring dampeners 24 and various other vibration dampeners 26 to reduce the amount of noise generated when the bow 10 is released. In addition, the bow 10 includes a quiver 28 capable of holding a plurality of arrows (not shown) within easy access of the user.

It should be appreciated that the bow sight 20 can be used with any suitable bow. The bow 10 is shown as one example of a type of bow that is suitable to be used with the bow sight 20. Other bows that can use the bow sight 20 include other compound bows, recurve bows, reflex bows, long bows, and the like.

Turning now to FIGS. 2-5, the bow sight 20 includes a mounting component 30 (alternatively referred to herein as a mounting portion, mounting body, or mounting end), an adjustment system or adjustment assembly 32, and a sight component 34 (alternatively referred to herein as a sight portion, sight body, or sight end). The mounting component 30 is the portion of the bow sight 20 that is coupled to the bow 10. The adjustment system 32 is configured to adjust the position of the sight component 34 relative to the mounting component 30. The sight component 34 includes that portion of the bow sight that is adjustable relative to the mounting component 30. The sight component 34 is also the portion of the bow sight 20 that is used to aim the bow.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The mounting component 30 includes a mounting member 36 (alternatively referred to herein as a mounting bracket, frame, or mounting element) that can be coupled to the bow 10. In FIG. 1, the mounting member 36 is coupled to the riser 14 of the bow 10. It should be appreciated, however, that although the mounting member 36 is typically coupled to the riser of a bow, the mounting member 36 can also be coupled to any other suitable portion of the bow 10.

The mounting member 36 includes a plurality of holes 38 that are sized to receive fasteners or bolts to attach the mounting member 36 to the riser 14. The riser 14 includes a plurality of corresponding holes to receive the fasteners. Once in place, the fasteners may be tightened to couple the mounting member 36 to the bow 10. It should be appreciated that the mounting member 36 can also be coupled to the bow 10 using any suitable fastening device or system so long as the bow sight 20 is held in a fixed position relative to the bow 10.

In one embodiment, the mounting member 36 includes a plurality of cut-outs 39 that serve to reduce the overall weight of the bow sight 20 and to provide an aesthetically distinct and/or pleasing appearance to the bow sight 20. It should be appreciated that the mounting member 36 can have any suitable configuration so long as it is capable of reliably holding the bow sight 20 to the bow 10. For example, the mounting member 36 can be made of two or more distinct components such as two or more brackets coupled together.

In another embodiment, the mounting component 30 may be adjustable lengthwise. This allows the user to move the sight component 34 closer or further away from the user. This may be accomplished using any of a variety of different configurations. For example, in one embodiment, a mounting bracket may be fixed to the riser 14 that has a dovetail shaped groove or channel in it. An extension bracket is coupled to and extends from the adjustment system 32. The extension bracket has a dovetail shape that allows it to slide within the groove in the mounting bracket.

The extension bracket slides into the mounting bracket to couple the bow sight 20 to the bow 10. The extension bracket is held in place by a retention member (e.g., a thumb screw that passes through the mounting bracket and contacts the extension bracket) to prevent the bow sight 20 from moving or falling off. This embodiment of the mounting component 30 may be desirable in situations where the user wants to quickly and easily change sights.

The sight component 34 is coupled to the mounting component 30 by way of the adjustment system 32. The sight component 34 includes a sight bracket 40 coupled to a sight assembly 42. Although the sight bracket 40 and the sight assembly 42 are shown as being separate pieces, it should be appreciated that the sight bracket 40 and the sight assembly 42 can also be a single integrated piece of material.

The sight assembly 42 includes a sight housing 44 (alternatively referred to herein as a sight guard or pin guard) that defines a sight window 46. A plurality of sight pins 48 are coupled to the sight bracket 40 and extend outward into the sight window 46. The sight assembly 42 may also include other components such as a bubble level. A bubble level allows the user to keep the bow 10 perfectly upright when shooting. If the bow 10 is titled to the left or the right when fired, then the arrow is likely to land to the left or right, respectively, of the target.

The sight pins 48 are coupled to the sight bracket 40 by a plurality of fasteners 50. The fasteners 50 are positioned in a channel or plurality of channels 51 that allow the fasteners 50 and, consequently, the sight pins 48 to be adjusted vertically. A sight pin 48 can be adjusted by loosening the corresponding fastener 50, moving the sight pin 48 to the desired position, and tightening the fastener 50. In this manner, the user can adjust the position of each sight pin 48 so that it is accurate at a certain range.

It should be appreciated that although the sight pins 48 are referred to as "pins," the sight pin 48 itself can have any suitable shape such as rectangular, cylindrical, arcuate, triangular, elliptical, and so forth. For example, the sight pins 48 shown in the FIGS. have a blade like shape. The sight pins 48 should be configured to make it simple and easy for the user to aim the bow (e.g., sight pins 48 should have a small visible footprint when aiming the bow).

Figure 5:
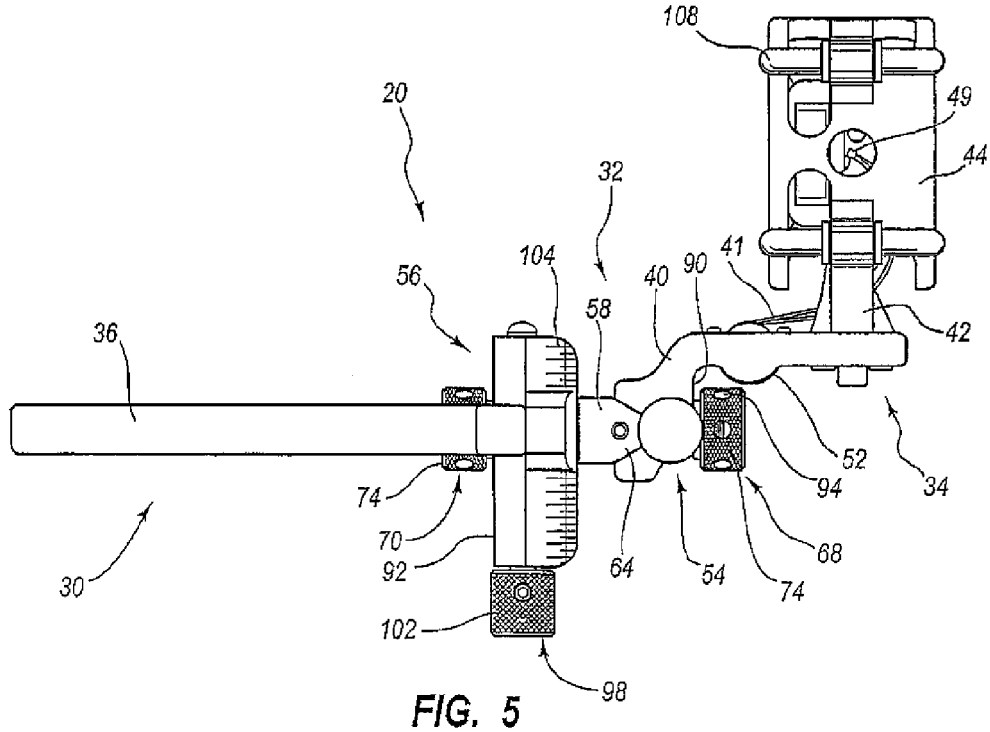
FIG. 5 shows a top view of the bow sight from FIG. 1.

At the end of each sight pin 48 is a sight indicia 49 (FIG. 5). The sight indicia 49 can be any point or indicia of any type that is visually placed in line with a target to assist in the proper aiming of the bow 10. Although sight indicia 49 are often circular, sight indicia 49 can have any suitable shape such as diamond, square, star, and other geometrical shapes. The sight indicia 49 may also be colored. The sight indicia 49 of the various sight pins 48 may have different colors to make it easier for the user to quickly identify the correct sight pin 48 to use for a given range.

In one embodiment, the sight indicia 49 may include a light enhancing material. The light enhancing material may make the sight indicia 49 look brighter or glow. This may be especially useful in low light conditions, which are often encountered while hunting. Suitable light enhancing materials include radioactive materials such as tritium and photoluminescent materials such as strontium oxide aluminate. These materials may be adhered to the end of the sight pins 48 using any suitable technique.

Figure 2:
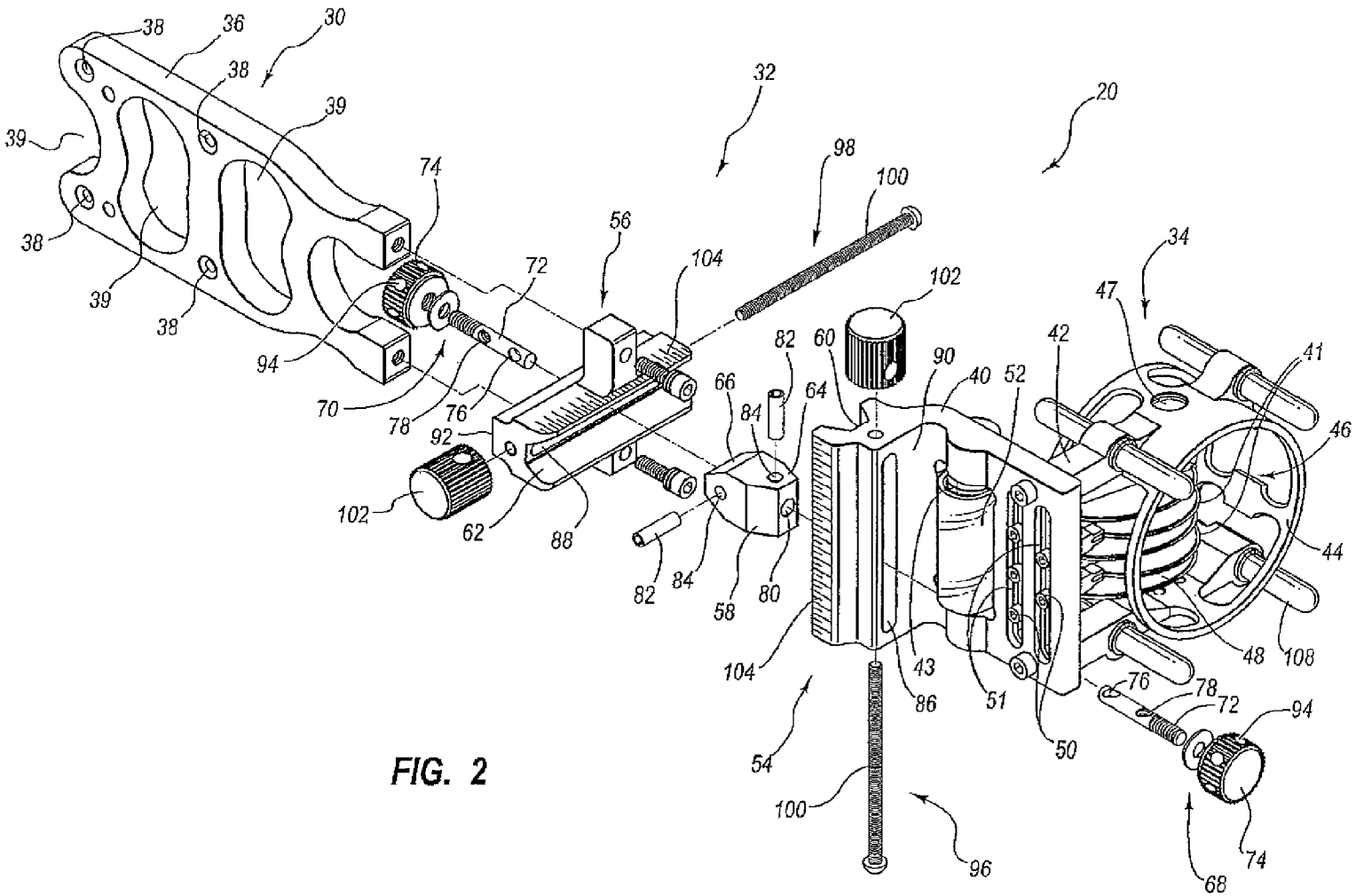
FIG. 2 shows a perspective view of the exploded bow sight from FIG. 1.
Figure 3:
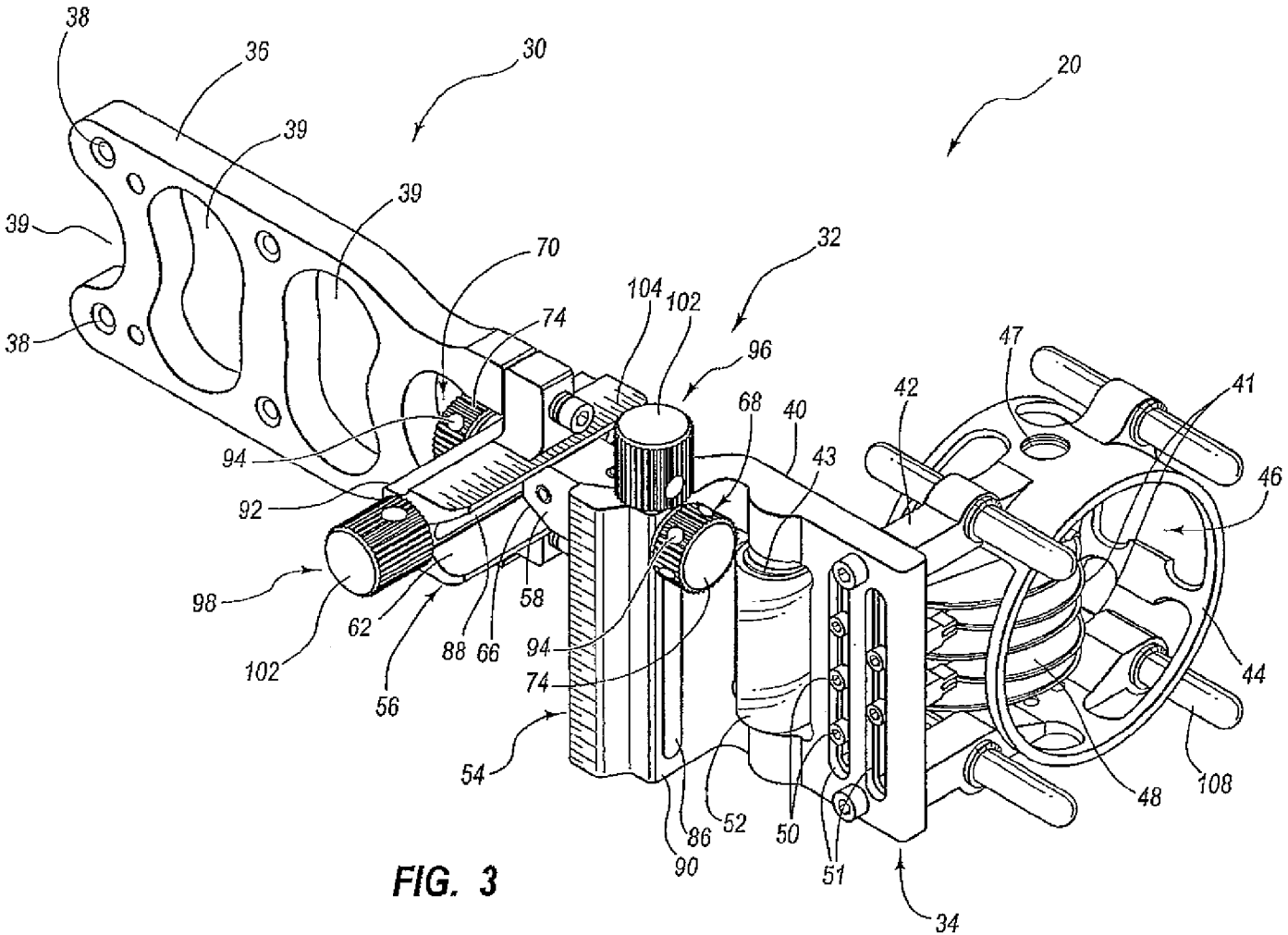
FIG. 3 shows a perspective view of the assembled bow sight from FIG. 1.
Figure 4:
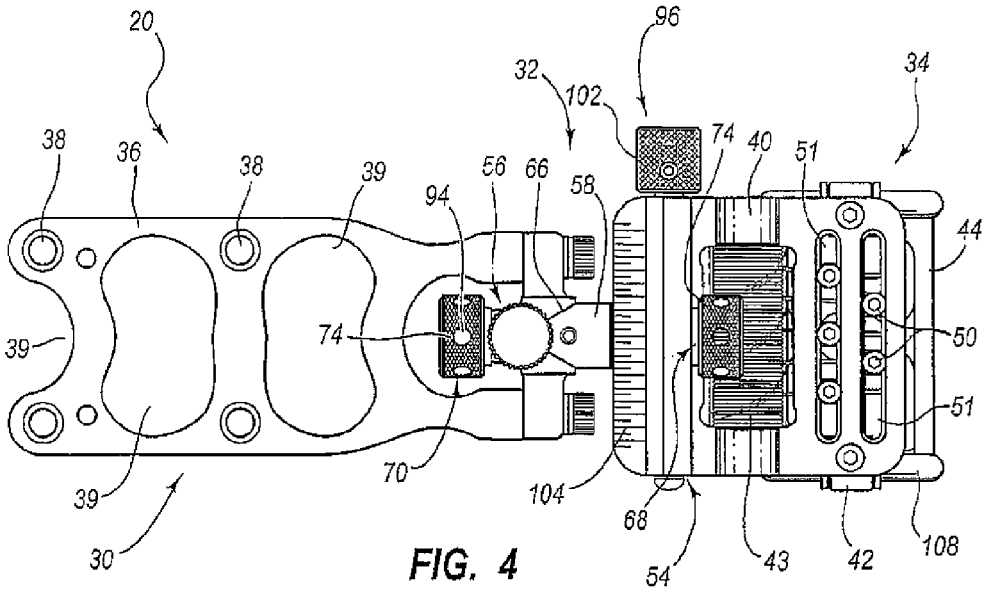
FIG. 4 shows a side view of the bow sight from FIG. 1.

Another light enhancing material is fiber optic fibers. Referring to FIGS. 2-4, the sight indicia 49 comprises a plurality of fiber optic fibers 41 that are coiled on a spool 43 and wrapped around the back of the corresponding sight pins 48. The fibers 41 terminate at the end of the sight pins 48. The core of the fiber optic fibers 41 are exposed at the end of the sight pins 48. The fibers 41 capture light and transmit it to the exposed ends of the fibers 41. This creates a bright dot that is easy for the user to see. The fiber optic fibers 41 may be chosen to be different colors so that the dot for a particular range is easy to identify. A guard 52 is positioned over the coil of fibers 41 to protect the fibers 41 from being damaged.

In one embodiment a secondary light source may be coupled to the sight housing 44 to illuminate the sight pins 48. The secondary light source may be battery powered or may operate using chemical light sticks. The secondary light source may be configured to shine directly on sight pins 48 or on the fiber optic fibers 41 coiled on the spool 43. The secondary light source may be configured to mount in threaded hole 47 shown in FIGS. 2 and 3.

The adjustment system 32 allows the user to adjust the position of the sight component 34 relative to the mounting component 30. The adjustment system 32 is commonly referred to as a gang adjustment system since it moves all of the sight pins 48 together. Gang adjustment systems make it easier to initially setup and sight-in the bow. Also, gang adjustment systems provide the bow sight 20 with a greater range of possible settings. Without a gang adjustment system, the user would have to adjust each sight pin 48 individually—a process that can be very time consuming and difficult.

The adjustment system 32 includes a first adjustment mechanism or elevation adjustment mechanism 54, a second adjustment mechanism or windage adjustment mechanism 56, and a stop member or block 58. The elevation adjustment mechanism 54 allows the user to adjust the elevation of the sight component 34, and the windage adjustment mechanism 56 allows the user to adjust the windage (right and left movement) of the sight component 34. The stop member 58 is used to hold the adjustment mechanisms 54, 56 in a fixed position.

The elevation adjustment mechanism 54 includes a channel or groove 60 that is sized and shaped to receive a first projection 64 of the stop member 58. Likewise, the windage adjustment mechanism 56 includes a channel or groove 62 that is sized and shaped to receive a second projection 66 of the stop member 58. As shown in FIG. 2, the projections 64, 66 are positioned on opposite sides of the stop member 58. The projections 64, 66 have similar shapes and are rotated 90° relative to each other.

Each adjustment mechanism 54, 56 is configured to move between a first configuration where the respective projection 64, 66 of the stop member 58 is compressed against the respective channel 60, 62 to hold the adjustment mechanism 54, 56 in a fixed position and a second configuration where the respective projection 64, 66 is loosened to allow the adjustment mechanism 54, 56 to be adjusted. In the embodiment shown in the FIGS., the channels 60, 62 have a V shape and the projections 64, 66 have a corresponding inverted V shape that allows the projections 64, 66 to fit in the channels 60, 62. The matching shapes of the channels 60, 62 and the projections 64, 66 also allow the projections 64, 66 to move lengthwise along the channels 60, 62 when the adjustment mechanisms 54, 56 are adjusted.

The design of the channels 60, 62 acts to securely hold the projections 64, 66 in place when the stop member 58 and the respective adjustment mechanism 54, 56 are compressed together. In particular, the inclined walls of the channels 60, 62 prevent the stop member 58 from moving perpendicularly relative to the channels 60, 62. In contrast, if the channels 60, 62 and the projections 64, 66 were replaced with flat surfaces, the stop member 58 and the respective adjustment mechanisms 54, 56 would be much more susceptible to unwanted movement. That being said, it should be appreciated that the stop member 58 and the adjustment mechanisms 54, 56 may have flat surfaces that contact each other. The surfaces of the stop member 58 and the adjustment mechanisms 54, 56 may also have any other suitable design. For example, the position of the channels 60, 62 and projections 64, 66 may be reversed so that the adjustment mechanisms 54, 56 have projections that are received by channels in the stop member 58. Numerous other configurations are also contemplated.

It should be appreciated that although the configuration of the adjustment system 32 can be varied in any of a number of ways. For example, in one embodiment, the adjustment system 32 may include two or more stop members 58. In another embodiment, the elevation adjustment mechanism 54 may be coupled to the mounting component 30, and the windage adjustment mechanism 56 may be coupled to the sight component 34.

The adjustment system 32 includes a first tightening device 68 that is used to compress the elevation adjustment mechanism 54 and the stop member 58 together and a second tightening device 70 that is used to compress the windage adjustment mechanism 56 and the stop member 58 together. Each tightening device 68, 70 includes a rod 72 and a knob 74. The rods 72 are at least partially threaded to receive the knobs 74 and have two holes 76, 78. The stop member 58 includes holes 80 that are configured to receive the ends of the rods 72 as shown in FIG. 2. Also, the other ends of the rods 72 are threaded to allow the knobs 74 to screw on the rods 72. The rods 72 are coupled to the stop member 58 using roll pins 82. The roll pins 82 extend through holes 84 in the stop member 58 and holes 76 in the rods 72 to hold the rods 72 together with the stop member 58.

The rods 72 extend through the bottom of the channels 60, 62 of the adjustment mechanisms 54, 56 and out through slots 86, 88 in the back side 90, 92 of the respective adjustment mechanisms 54, 56 to the knobs 74. When the knobs 74 are tightened a tension force is exerted on the rods 72. The knobs 74 contact the back sides 90, 92 and draw the projections 64, 66 into the channels 60, 62 with enough force to hold the adjustment mechanisms 54, 56 in a fixed position. Tightening the knobs 74 compresses or exerts a compressive force on the respective adjustment mechanisms 54, 56 and the stop member 58. The tension forces exerted on the rods 72 and the corresponding compressive forces exerted on the adjustment mechanisms 54, 56 and the stop member 58 are parallel to each other and to the lengthwise axis of the bow sight 20. Tightening the tightening devices 68, 70 moves the adjustment mechanisms 54, 56 toward each other even if by only a relatively small or minor amount.

The configuration and use of the two separate tightening devices 68, 70 is advantageous because each adjustment mechanism 54, 56 can be loosened and adjusted independently. For example, the windage of the sight pins 48 can be adjusted by loosening the tightening device 70, moving the windage adjustment mechanism 56, and tightening the tightening device 70. During this procedure, the tightening device 68 maintains a compressive force on the stop member 58 and the elevation adjustment mechanism 54 which holds the elevation adjustment mechanism 56 in a fixed position. There is no need to release the compressive force exerted on the elevation adjustment mechanism 54 in order to adjust the windage adjustment mechanism 56 or vice versa.

In an alternative embodiment, the rods 72 may be replaced with a single rod that extends through the slot 90 in the elevation adjustment mechanism 54, all the way through the stop member 58, and through the slot 92 in the windage adjustment mechanism 56. Each end of the rod is threaded and configured to receive one of the knobs 74. This configuration allows the user to tighten both adjustment mechanisms 54, 56 at the same time by rotating knob 74.

Referring to FIG. 2, the knobs 74 each include a plurality of holes 94 around the perimeter. The holes 94 are sized to receive a lever (not shown) to give the user additional leverage and make it easier to tighten the tightening devices 68, 70. In other embodiments, the knobs 74 may be configured without the holes 94.

Referring to FIGS. 2-5, each of the adjustment mechanisms 54, 56 include a micro or fine adjustment assembly 96, 98, respectively. Each micro adjustment assembly 96, 98 includes a bolt or compression member 100 and a knob 102. The bolts 100 extend lengthwise through the adjustment mechanisms 54, 56 as shown in FIG. 2. The bolts 100 also extend through the holes 78 in the rods 72. The knobs 102 are coupled to the ends of the bolts 100 opposite the head. The knobs 102 are secured to the bolts 100 so that the knobs 102 and the bolts 100 rotate together. The holes 78 in the rods 72 are threaded so that as knobs 102 are rotated, the adjustment mechanisms 54, 56 and the stop member 58 move relative to each other. As shown in the FIGS., markings 104 may be provided on the sides of the adjustment mechanisms 54, 56 to provide a visual indication of the position of adjustment mechanisms 54, 56. The markings 104 may be used to easily and reliably move the adjustment mechanisms 54, 56 from one setting to another setting.

The user can adjust the bow sight 20 using the micro adjustment assemblies 96, 98 as follows. First, the appropriate tightening device 68, 70 needs to be loosened depending on whether the elevation or windage needs to be adjusted. Once loosened, the user can turn the knob 102 of the corresponding micro adjustment assembly 96, 98 to move the adjustment mechanism 54, 56 relative to the stop member 58. It should be noted that the micro adjustment assemblies 96, 98 prevent the adjustment mechanisms 54, 56 from moving freely relative to the stop member 58. The adjustment mechanisms 54, 56 only move if the corresponding micro adjustment assembly 96, 98 is adjusted. Once the adjustment mechanism 54, 56 is in place, the user tightens the tightening device 68, 70 back up again to hold the adjustment mechanism 54, 56 in a fixed position. There is enough play in the micro adjustment assemblies 96, 98 that it is generally desirable to include the tightening devices 68, 70 to securely hold the adjustment mechanisms 54, 56 in a fixed position.

The design of the bow sight 20 is compact and easy to use. This design of the bow sight 20 allows the adjustment mechanisms 54, 56 to move together when compressed against the stop member 58. Also, since the bolts 100 extend through the threaded holes 78 in the rods 72, the knobs 74 can be taken completely off and the adjustment system 32 stays together. The bolts 100 keep the rods 72 from separating from the adjustment mechanisms 54, 56. Since the bolts 100 prevent large amounts of lengthwise movement of the rods 72, it is generally desirable to design the adjustment system 32 so that the stop member 58 is positioned quite close to the adjustment mechanisms 54, 56. This way, the stop member 58 does not need to move very far to come into full contact with the adjustment mechanisms 54, 56 and prevent them from moving.

It should be appreciated that the adjustment system 32 can be separate from or integrated, in whole or in part, into the mounting component 30 and/or the sight component 34. For example, as shown in the FIGS., the elevation adjustment mechanism 54 is provided as an integral part of the sight component 34. On the other hand, the windage adjustment mechanism 56 is provided as a separate component that is coupled to the mounting component 30.

It should also be appreciated that the bow sight 20 can be configured as a fixed pin sight, a movable pin sight (as shown in the FIGS.), a pendulum sight, or the like. In addition, the bow sight 20 may have zero pin gap sight pins as well as second and third axis adjustments. The second axis adjustment refers to adjustments that allow the user to tilt the sight assembly 42 side to side to ensure that the bubble level correctly indicates when the sight assembly 42 is level. Third axis adjustments refer to adjustments that allow the user to tilt the sight assembly 42 forward or backward.

It should be appreciated that the bow sight 20 may be made from any suitable material. In one embodiment, the bow sight 20 may be machined from aluminum. In another embodiment, the bow sight 20 may be made of plastic. It should also be appreciated that the bow sight 20 may have vibration dampeners 108 coupled to it. The vibration dampeners 108 may be positioned at any suitable location on the bow sight 20.

Illustrative Embodiments

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

According to one embodiment, a bow sight comprises: an elevation adjustment mechanism; and a windage adjustment mechanism; wherein the elevation adjustment mechanism and/or the windage adjustment mechanism moves toward one another to hold the elevation adjustment mechanism and/or the windage adjustment mechanism in a fixed position. The elevation adjustment mechanism and the windage adjustment mechanism may move toward one another and contact a stop member to hold the elevation adjustment mechanism and the windage adjustment mechanism in the fixed position. The elevation adjustment mechanism and the windage adjustment mechanism may move toward one another and contact the same stop member to hold the elevation adjustment mechanism and the windage adjustment mechanism in the fixed position. The elevation adjustment mechanism and/or the windage adjustment mechanism may move toward one another in a direction that is parallel to a lengthwise axis of the bow sight to hold the elevation adjustment mechanism and/or the windage adjustment mechanism in a fixed position. The elevation adjustment mechanism and/or the windage adjustment mechanism may move away from one another to allow the elevation adjustment mechanism and/or the windage adjustment mechanism to be adjusted. The elevation adjustment mechanism may be fixed to a sight component of the bow sight and the windage adjustment mechanism may be fixed to a mounting component of the bow sight. The bow sight may comprise a stop member positioned between the elevation adjustment mechanism and the windage adjustment mechanism, wherein the stop member contacts opposing sides of the elevation adjustment mechanism and the windage adjustment mechanism to hold the elevation adjustment mechanism and the windage adjustment mechanism in the fixed position. The bow sight may comprise a tightening device configured to move the elevation adjustment mechanism and/or the windage adjustment mechanism toward one another to hold the elevation adjustment mechanism and/or the windage adjustment mechanism in the fixed position.

According to another embodiment, a bow sight comprises: an elevation adjustment mechanism; a windage adjustment mechanism; and a stop member positioned between the elevation adjustment mechanism and the windage adjustment mechanism; wherein the stop member contacts opposing sides of the elevation adjustment mechanism and the windage adjustment mechanism to hold the elevation adjustment mechanism and the windage adjustment mechanism in a fixed position. The opposing sides of the elevation adjustment mechanism and the windage adjustment mechanism may be perpendicular to one another. The elevation adjustment mechanism may be fixed to a sight component of the bow sight and the windage adjustment mechanism may be fixed to a mounting component of the bow sight. The bow sight may comprise a tightening device configured to move the elevation adjustment mechanism and/or the windage adjustment mechanism into contact with the stop member to hold the elevation adjustment mechanism and/or the windage adjustment mechanism in the fixed position.

According to another embodiment, a bow sight comprises: an elevation adjustment mechanism including a channel a windage adjustment mechanism including a channel; and a stop member including a first projection and a second projection; wherein the first projection is configured to contact the channel of the elevation adjustment mechanism to hold the elevation adjustment mechanism in a fixed position and the second projection is configured to contact the channel of the windage adjustment mechanism to hold the windage adjustment mechanism in a fixed position. The first projection and the second projection may be positioned on opposite sides of the stop member. The bow sight may comprise a first tightening device that forces the first projection into contact with the channel of the elevation adjustment mechanism to hold the elevation adjustment mechanism in the fixed position and a second tightening device that forces the second projection into contact with the channel of the windage adjustment mechanism to hold the windage adjustment mechanism in the fixed position.

According to another embodiment, a bow sight comprises: an elevation adjustment mechanism; and a windage adjustment mechanism, the elevation adjustment mechanism and the windage adjustment mechanism each being configured to adjust a sight component of the bow sight relative to a mounting component of the bow sight; wherein the elevation adjustment mechanism and the windage adjustment mechanism are each held in a fixed position by a force, the forces being at least substantially parallel to each other. The forces may be at least substantially parallel to a lengthwise axis of the bow sight. The bow sight may comprise a tightening device that exerts the forces on the elevation adjustment mechanism and the windage adjustment mechanism. The bow sight may comprise a first tightening device that exerts the force on the elevation adjustment mechanism and a second tightening device that exerts the force on the windage adjustment mechanism. The bow sight may comprise a stop member positioned between the elevation adjustment mechanism and the windage adjustment mechanism, wherein one of the forces compress the elevation adjustment mechanism and the stop member together and the other one of the forces compress the windage adjustment mechanism and the stop member together.

According to another embodiment, a bow sight comprises: an elevation adjustment mechanism; and a windage adjustment mechanism, the elevation adjustment mechanism and the windage adjustment mechanism each being configured to adjust a sight component of the bow sight relative to a mounting component of the bow sight; wherein the elevation adjustment mechanism and the windage adjustment mechanism are each held in a fixed position by a force that is at least substantially parallel to a lengthwise axis of the bow sight. The bow sight may comprise a tightening device that exerts the forces on the elevation adjustment mechanism and the windage adjustment mechanism. The bow sight may comprise a first tightening device that exerts the force on the elevation adjustment mechanism and a second tightening device that exerts the force on the windage adjustment mechanism. The bow sight may comprise a stop member positioned between the elevation adjustment mechanism and the windage adjustment mechanism, wherein one of the forces compress the elevation adjustment mechanism and the stop member together and the other one of the forces compress the windage adjustment mechanism and the stop member together.

According to another embodiment, a bow sight comprises: an elevation adjustment mechanism; a windage adjustment mechanism; a stop member positioned between the elevation adjustment mechanism and the windage adjustment mechanism; and a tightening device configured to move the elevation adjustment mechanism and/or the windage adjustment mechanism toward the stop member to hold the elevation adjustment mechanism and/or the windage adjustment mechanism in a fixed position. The tightening device may be a first tightening device configured to compress the elevation adjustment mechanism and the stop member together to hold the elevation adjustment mechanism in the fixed position, the bow sight may comprise a second tightening device configured to compress the windage adjustment mechanism and the stop member together to hold the windage adjustment mechanism in the fixed position. The first tightening device and the second tightening device may be in line with each other. The tightening device may be configured to compress the elevation adjustment mechanism and the windage adjustment mechanism toward the stop member to hold the elevation adjustment mechanism and the windage adjustment mechanism in the fixed position. The elevation adjustment mechanism may be fixed to a sight component of the bow sight and the windage adjustment mechanism may be fixed to a mounting component of the bow sight.

According to another embodiment, a bow sight comprises: a gang adjustment system including an elevation adjustment mechanism; and a windage adjustment mechanism; wherein the elevation adjustment mechanism and the windage adjustment mechanism are each held in a fixed position by a force, the forces being at least substantially parallel to each other.

According to another embodiment, a bow sight comprises: a gang adjustment system including an elevation adjustment mechanism; and a windage adjustment mechanism; wherein the elevation adjustment mechanism and the windage adjustment mechanism are each held in a fixed position by a force that is at least substantially parallel to a lengthwise axis of the bow sight.

According to another embodiment, a bow sight comprises: an elevation adjustment mechanism; a windage adjustment mechanism; and a stop member; wherein the elevation adjustment mechanism is held in a fixed position by a first compressive force exerted on the elevation adjustment mechanism and the stop member; wherein the windage adjustment mechanism is held in a fixed position by a second compressive force exerted on the windage adjustment mechanism and the stop member; and wherein the first compressive force and the second compressive force are at least substantially parallel to each other.

According to another embodiment, a bow sight comprises: an elevation adjustment mechanism; a windage adjustment mechanism; and a stop member; wherein the elevation adjustment mechanism is held in a fixed position by a first compressive force exerted on the elevation adjustment mechanism and the stop member; wherein the windage adjustment mechanism is held in a fixed position by a second compressive force exerted on the windage adjustment mechanism and the stop member; and wherein the first compressive force and the second compressive force are at least substantially parallel to a lengthwise axis of the bow sight.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A bow sight comprising:

an elevation adjustment mechanism;

a windage adjustment mechanism; and a stop member including a first projection and a second projection, wherein the first projection and the second projection are positioned on opposite sides of the stop member, and wherein the first projection and the second projection extend opposite each other;

wherein the elevation adjustment mechanism moves towards the windage adjustment mechanism to hold the elevation adjustment mechanism in a fixed position or the windage adjustment mechanism moves towards the elevation adjustment mechanism to hold the windage adjustment mechanism in a fixed position.

2. The bow sight of claim 1 wherein the elevation adjustment mechanism and the windage adjustment mechanism move toward one another and contact the stop member to hold the elevation adjustment mechanism and the windage adjustment mechanism in the fixed position.

3. The bow sight of claim 1 wherein the elevation adjustment mechanism and the windage adjustment mechanism move towards one another in a direction that is parallel to a lengthwise axis of the bow sight to hold the elevation adjustment mechanism and the windage adjustment mechanism in a fixed position.

4. The bow sight of claim 1 wherein the elevation adjustment mechanism and the windage adjustment mechanism moves away from one another to allow the elevation adjustment mechanism and the windage adjustment mechanism to be adjusted.

5. The bow sight of claim 1 wherein the elevation adjustment mechanism is fixed to a sight component of the bow sight and the windage adjustment mechanism is fixed to a mounting component of the bow sight.

6. The bow sight of claim 1 comprising stop member positioned between the elevation adjustment mechanism and the windage adjustment mechanism, wherein the stop member contacts opposing sides of the elevation adjustment mechanism and the windage adjustment mechanism to hold the elevation adjustment mechanism and the windage adjustment mechanism in the fixed position.

7. The bow sight of claim 1 comprising a tightening device configured to move the elevation adjustment mechanism and the windage adjustment mechanism towards one another to hold the elevation adjustment mechanism and the windage adjustment mechanism in the fixed position.

8. A bow sight comprising:

an elevation adjustment mechanism;

a windage adjustment mechanism; and a stop member, including a first projection and a second projection, positioned between the elevation adjustment mechanism and the windage adjustment mechanism, wherein the first projection and the second projection are positioned on opposite sides of the stop member, and wherein the first projection and the second projection extend opposite each other;

wherein the stop member contacts opposing sides of the elevation adjustment mechanism and the windage adjustment mechanism to hold the elevation adjustment mechanism and the windage adjustment mechanism in a fixed position.

9. The bow sight of claim 8 wherein the opposing sides of the elevation adjustment mechanism and the windage adjustment mechanism are perpendicular to one another.

10. The bow sight of claim 8 wherein the elevation adjustment mechanism is fixed to a sight component of the bow sight and the windage adjustment mechanism is fixed to a mounting component of the bow sight.

11. The bow sight of claim 8 comprising a tightening device configured to move the elevation adjustment mechanism and/or the windage adjustment mechanism into contact with the stop member to hold the elevation adjustment mechanism and/or the windage adjustment mechanism in the fixed position.

12. A bow sight comprising:

an elevation adjustment mechanism including a channel;

a windage adjustment mechanism including a channel; and a stop member including a first projection and a second projection, wherein the first projection and the second projection are positioned on opposite sides of the stop member;

wherein the first projection is configured to contact the channel of the elevation adjustment mechanism to hold the elevation adjustment mechanism in a fixed position and the second projection is configured to contact the channel of the windage adjustment mechanism to hold the windage adjustment mechanism in a fixed position.

13. The bow sight of claim 12 comprising a first tightening device that forces the first projection into contact with the channel of the elevation adjustment mechanism to hold the elevation adjustment mechanism in the fixed position and a second tightening device that forces the second projection into contact with the channel of the windage adjustment mechanism to hold the windage adjustment mechanism in the fixed position.

14. A bow sight comprising:

a stop member including a first projection and a second projection, wherein the first projection and the second projection are positioned on opposite sides of the stop member, and wherein the first projection and the second projection extend opposite each other;

an elevation adjustment mechanism; and a windage adjustment mechanism, the elevation adjustment mechanism and the windage adjustment mechanism each being configured to adjust a sight component of the bow sight relative to a mounting component of the bow sight;

wherein the elevation adjustment mechanism and the windage adjustment mechanism are each held in a fixed position against the stop member by a force, the forces being at least substantially parallel to each other.

15. The bow sight of claim 14 wherein the forces are at least substantially parallel to a lengthwise axis of the bow sight.

16. The bow sight of claim 14 comprising a tightening device that exerts the forces on the elevation adjustment mechanism and the windage adjustment mechanism.

17. The bow sight of claim 14 comprising a first tightening device that exerts the force on the elevation adjustment mechanism and a second tightening device that exerts the force on the windage adjustment mechanism.

18. The bow sight of claim 14 wherein the stop member is positioned between the elevation adjustment mechanism and the windage adjustment mechanism, wherein one of the forces compress the elevation adjustment mechanism and the stop member together and the other one of the forces compress the windage adjustment mechanism and the stop member together.

19. A bow sight comprising:

a stop member including a first projection and a second projection, wherein the first projection and the second projection are positioned on opposite sides of the stop member, and wherein the first projection and the second projection extend opposite each other;

an elevation adjustment mechanism; and a windage adjustment mechanism, the elevation adjustment mechanism and the windage adjustment mechanism each being configured to adjust a sight component of the bow sight relative to a mounting component of the bow sight;

wherein the elevation adjustment mechanism and the windage adjustment mechanism are each held in a fixed position against the stop member by a force that is at least substantially parallel to a lengthwise axis of the bow sight.

20. The bow sight of claim 19 comprising a tightening device that exerts the forces on the elevation adjustment mechanism and the windage adjustment mechanism.

21. The bow sight of claim 19 comprising a first tightening device that exerts the force on the elevation adjustment mechanism and a second tightening device that exerts the force on the windage adjustment mechanism.

22. The bow sight of claim 19 wherein the stop member is positioned between the elevation adjustment mechanism and the windage adjustment mechanism, wherein one of the forces compress the elevation adjustment mechanism and the stop member together and the other one of the forces compress the windage adjustment mechanism and the stop member together.

23. A bow sight comprising:

an elevation adjustment mechanism;

a windage adjustment mechanism;

a stop member, including a first projection and a second projection, positioned between the elevation adjustment mechanism and the windage adjustment mechanism, wherein the first projection and the second projection are positioned on opposite sides of the stop member, and wherein the first projection and the second projection extend opposite each other; and a tightening device configured to move the elevation adjustment mechanism and/or the windage adjustment mechanism toward the stop member to hold the elevation adjustment mechanism and/or the windage adjustment mechanism in a fixed position.

24. The bow sight of claim 23 wherein the tightening device is a first tightening device configured to compress the elevation adjustment mechanism and the stop member together to hold the elevation adjustment mechanism in the fixed position, the bow sight comprising a second tightening device configured to compress the windage adjustment mechanism and the stop member together to hold the windage adjustment mechanism in the fixed position.

25. The bow sight of claim 24 wherein the first tightening device and the second tightening device are in line with each other.

26. The bow sight of claim 23 wherein the tightening device is configured to compress the elevation adjustment mechanism and the windage adjustment mechanism toward the stop member to hold the elevation adjustment mechanism and the windage adjustment mechanism in the fixed position.

27. The bow sight of claim 23 wherein the elevation adjustment mechanism is fixed to a sight component of the bow sight and the windage adjustment mechanism is fixed to a mounting component of the bow sight.

* * * * *